US011221118B2

(12) United States Patent
Zhu et al.

(10) Patent No.: US 11,221,118 B2
(45) Date of Patent: Jan. 11, 2022

(54) ILLUMINATION MODULE, VEHICLE LAMP, AND VEHICLE

(71) Applicant: HASCO Vision Technology Co., LTD., Shanghai (CN)

(72) Inventors: He Zhu, Shanghai (CN); Dapan Zhang, Shanghai (CN); Zhiping Qiu, Shanghai (CN)

(73) Assignee: HASCO Vision Technology Co., LTD, Shanghai (CN)

( * ) Notice: Subject to any disclaimer, the term of this patent is extended or adjusted under 35 U.S.C. 154(b) by 0 days.

(21) Appl. No.: 17/282,699

(22) PCT Filed: Sep. 24, 2019

(86) PCT No.: PCT/CN2019/107440
§ 371 (c)(1),
(2) Date: Apr. 2, 2021

(87) PCT Pub. No.: WO2020/232933
PCT Pub. Date: Nov. 26, 2020

(65) Prior Publication Data

US 2021/0381667 A1 Dec. 9, 2021

(30) Foreign Application Priority Data

May 21, 2019 (CN) ..... 201920738614.8

(51) Int. Cl.
*F21S 41/143* (2018.01)
*F21S 41/151* (2018.01)
(Continued)

(52) U.S. Cl.
CPC ..... *F21S 41/143* (2018.01); *F21S 41/151* (2018.01); *F21S 41/24* (2018.01); *F21S 41/322* (2018.01);
(Continued)

(58) Field of Classification Search
CPC ..... F21S 41/143; F21S 41/24; F21S 41/322
See application file for complete search history.

(56) References Cited

U.S. PATENT DOCUMENTS 10,180,215 B2 1/2019 Wolfenden, Jr. et al.

FOREIGN PATENT DOCUMENTS

CN 204285306 U 4/2015
CN 105276487 A 1/2016
(Continued)

*Primary Examiner* — Vip Patel
(74) *Attorney, Agent, or Firm* — Volpe Koenig

(57) ABSTRACT

An illumination module, and a vehicle lamp and vehicle comprising the module. The illumination module, comprises a low-beam light source, a low-beam optical element, a high-beam light source, and a high-beam optical element. The low-beam optical element comprises a light incident portion and a reflection portion; the light incident portion is configured as a light gathering structure; the low-beam light source is provided at a position where the low-beam beam generated by the low-beam light source can pass through the light incoming parts; the reflection portion is provided below a light emission direction of the light incident portion, and a cut-off line is formed at a front end of the reflection portion; the high-beam light sources and the high-beam optical element are provided below the reflection portion. The illumination module is simple in structure and design and can improve light energy utilization efficiency while facilitating a compact and attractive design.

20 Claims, 3 Drawing Sheets

(51) Int. Cl.

| | |
|---|---|
| ***F21S 41/663*** | (2018.01) |
| ***F21S 41/32*** | (2018.01) |
| ***F21S 41/24*** | (2018.01) |
| *F21Y 115/10* | (2016.01) |

(52) U.S. Cl.
CPC ..... *F21S 41/663* (2018.01); *F21Y 2115/10* (2016.08)

(56) References Cited

FOREIGN PATENT DOCUMENTS

| | | | |
|---|---|---|---|
| CN | 106439672 | A | 2/2017 |
| CN | 106641964 | A | 5/2017 |
| CN | 107131462 | A | 9/2017 |

ILLUMINATION MODULE, VEHICLE LAMP, AND VEHICLE

CROSS REFERENCE TO RELATED APPLICATIONS

This application is a 35 USC § 371 National Stage application of International Patent Application No. PCT/CN2019/107440, which was filed Sep. 24, 2019, entitled "ILLUMINATION MODULE, VEHICLE LAMP, AND VEHICLE," and claims priority to Chinese Patent Application No. 201920738614.8, filed May 21, 2019, both of which are incorporated herein by reference as if fully set forth.

FIELD OF THE INVENTION

The present disclosure relates to a vehicle illumination device, in particular to a illumination module. The present disclosure also relates to a vehicle lamp and a vehicle.

BACKGROUND OF THE INVENTION

Vehicles are an essential means of transportation for people travelling nowadays. However, there are times when we may have trouble seeing things clearly while driving a car, like in foggy days or at night. In these cases, illumination devices allow drivers to observe the surrounding road conditions, and also warn vehicles running in the opposite direction and pedestrians as well, thus reducing the occurrence of traffic accidents.

High-beam lights and low-beam lights are common illumination devices for vehicles in the running process. High-beam lights are generally used when driving in open areas or dark places such as highways or suburban areas. When two vehicles from the opposite directions meet, low-beam lights are adopted. Low-beam lights are also generally used when driving on urban roads to prevent potential safety hazards caused by high-beam lights, as the high angles of the high-beam lights may affect the sight of drivers of the opposite side and pedestrians on the road.

In the prior art, a reflector is often added at the low-beam light by a designer. However, as the reflector is generally quite large, when serving as a low-beam optical element, it may make the size of a illumination module too large, which has an adverse effect on the miniaturization and beautification of a lighting device. Moreover, the reflector used in the illumination module may cause 15%-20% energy loss to the light, making the optical efficiency of the whole low beam system lower.

In view of this, it is necessary to provide a illumination module scheme which can improve the light energy utilization efficiency.

SUMMARY OF THE INVENTION

The technical problem to be solved in a first aspect of the present disclosure is to provide an illumination module which is simple in structure and reasonable in design, can improve the utilization efficiency of light energy, and is beneficial to miniaturization and beautification of vehicle lamps.

The technical problem to be solved in a second aspect of the present disclosure is to provide a vehicle lamp, which has a high utilization efficiency of light energy, is simple in structure and is beneficial to miniaturization of vehicle lamp design.

The technical problem to be solved in a third aspect of the present disclosure is to provide a vehicle whose lamp has a high utilization efficiency of light energy, is simple in structure, is beneficial to miniaturization of vehicle lamp design and can make the vehicle look better.

In order to solve the above technical problems, the first aspect of the present disclosure provides a illumination module, which comprises a low-beam light source, a low-beam optical element, a high-beam light source and a high-beam optical element, wherein the low-beam optical element comprises a light incident portion and a reflection portion, the light incident portion is configured as a light gathering structure, and the low-beam light source is arranged at a position where the low-beam beam generated by the low-beam light sources can pass through the light incident portion; the reflection portion is arranged below a light emission direction of the light incident portion along the light emission direction, and a cut-off line is formed at a front end of the reflection portion; the high-beam light source and the high-beam optical element are arranged below the reflection portion.

Specifically, the light incident portion is of a cup-shaped structure capable of gathering light.

Preferably, there are the plurality of low-beam light sources which are arranged in a row at intervals.

Further preferably, there are the plurality of light incident portions, and the low-beam light sources and the light incident portions are arranged in a one-to-one correspondence mode.

More specifically, the reflection portion is a fully reflection portion.

Specifically, the light incident portion is independently arranged at an end region of the reflection portion and is spaced from the reflection portion at interval, the reflection portion is of a plate-like structure, and a thickness of the front end of the reflection portion is less than or equal to 1 mm; or the light incident portion is arranged at the end of the reflection portion and is intergrated with the reflection portion, lower surface of the light incident portion is provided as the reflection portion, and the front end of the reflection portion is connected with an arc-shaped light emission surface.

Preferably, the high-beam light source is Matrix light sources, and there are the plurality of high-beam light sources.

Further preferably, the high-beam light sources are single-chip LED light sources.

Specifically, the high-beam light sources are arranged at intervals into one row or the high beam light sources (3) are arranged at intervals into multiple rows in a vertical direction.

Specifically, an upper boundary of a front end of the high-beam optical element is in contact with the front end of the reflection portion; or a distance between the upper boundary of the front end of the high-beam optical element and the front end of the reflection portion is less than or equal to 2 mm.

Preferably, the number of light emitting chips of the low-beam light sources close to the optical axis is greater than or equal to 2.

Further preferably, the high-beam optical element comprises light inlet portions and light guide channels, wherein each light inlet portion is configured as a light gathering structure, the light inlet portions and the light guide channels are arranged in a one-to-one correspondence mode, and front ends of the light guide channels form a curved light outlet portion.

In the second aspect, the present disclosure provides a vehicle lamp comprising the illumination module according to any one of the above items in the first aspect.

In the third aspect, the present disclosure provides a vehicle comprising the illumination module according to any one of the above items in the first aspect and the vehicle lamp according to the second aspect.

According to the above technical solution, in the illumination module, the light incident portion and the reflection portion are arranged on the low-beam optical element, and light incident portion is designed into the light gathering structure, so that the light emitted by the low-beam light source is collected and collimated through the light incident portion of the light gathering structure, and the utilization efficiency of light energy is improved. According to the present disclosure, the reflection portion is arranged below the light emission direction of the light incident portion, so that a light beam incident on the reflection portion is reused through the reflection portion in this way, the light beam propagates forward to form effective light, and the utilization efficiency of low-beam light energy is improved. Besides, by arranging the light incident portion of the light gathering structure and the reflection portion, the separate arrangement of a large reflector is not needed so that the space occupied by the illumination module can be reduced and the miniaturization of the whole illumination module can be realized. Moreover, in the present disclosure, the front end of the reflection portion is provided with the cut-off line, so that there is no need to separately set up a cut-off line, and the structure of the illumination module is simplified.

Other advantages of the present disclosure and technical effects of preferred embodiments will be further explained in the following detailed embodiments.

DESCRIPTION OF REFERENCE NUMERALS

| | | | |
|---|---|---|---|
| 1 | low-beam light source | 2 | low-beam optical element |
| 3 | high-beam light source | 4 | high-beam optical element |
| 5 | lens | 6 | optical axis |
| 21 | light incident portion | 22 | reflection portion |
| 41 | light inlet portion | 42 | light guide channel |
| 43 | light outlet portion | | |

DETAILED DESCRIPTION OF THE EMBODIMENTS

Specific embodiments of the present disclosure will be described in further detail with reference to the accompanying drawings below. It should be understood that the specific embodiments described herein are only for the purpose of illustrating and explaining the present disclosure and are not intended to limit the present disclosure.

Figure 4:
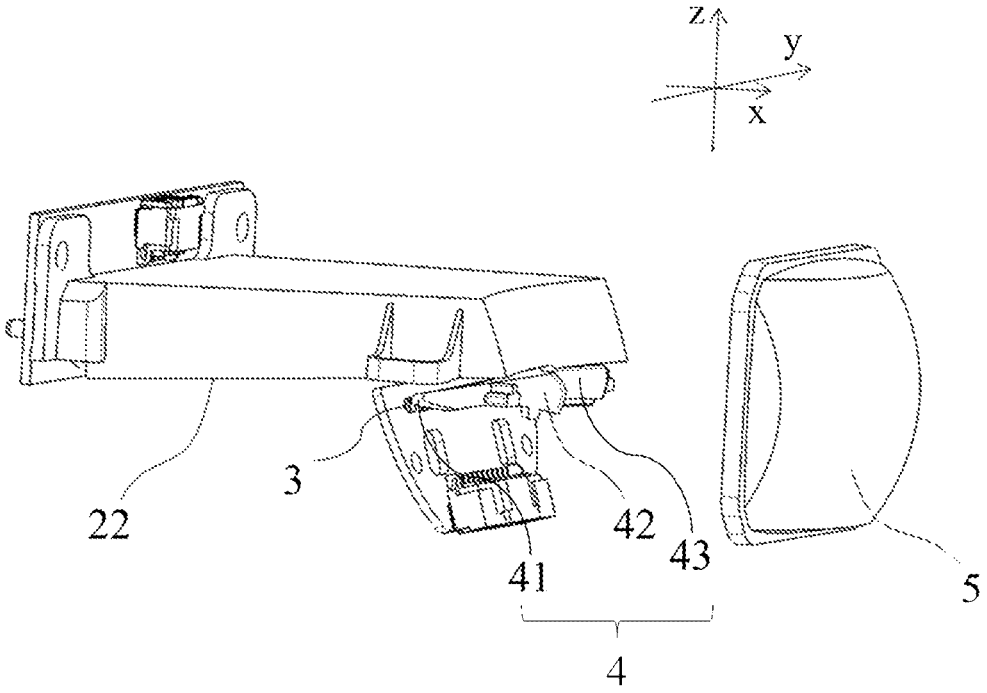
FIG. 4 is a perspective structural diagram of another embodiment of the present disclosure.

In the description of the present disclosure, it should be understood that the terms "upper", "lower", "left", "right", "front", "rear" and the like indicate the orientation or positional relationship based on the relative positional relationship of a illumination module installed on a vehicle. Specifically, as shown in FIG. 4, the direction indicated by the arrow in the x axis is "front" and the opposite direction is "rear"; the direction indicated by the arrow in the y axis is "left" and the opposite direction is "right"; and the direction indicated by the arrow in the z axis is "upper" and the opposite direction is "lower". More specifically, "front" refers to the position indicated by the outgoing direction of light, and "rear" refers to the opposite position.

Figure 1:
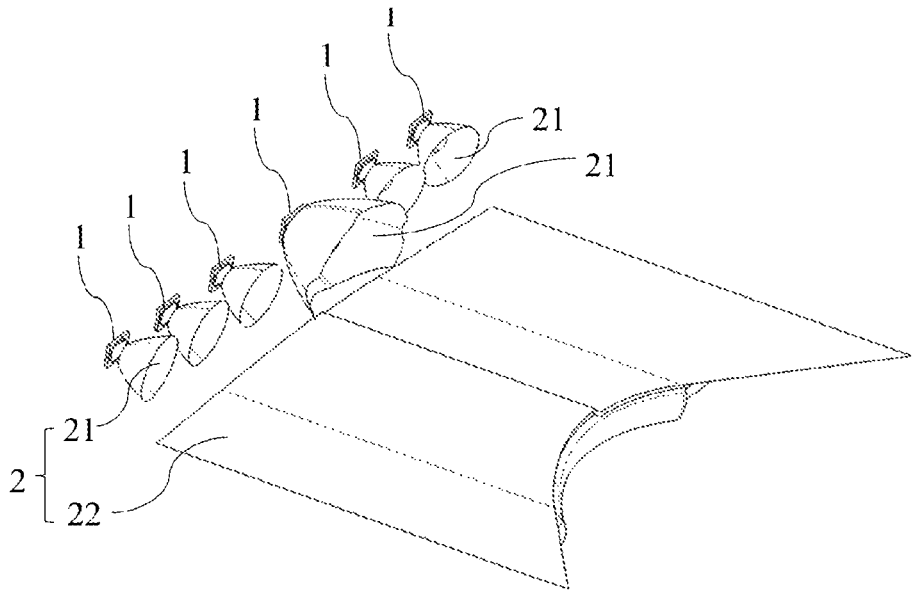
FIG. 1 is a perspective structural diagram of one embodiment of the present disclosure.
Figure 2:
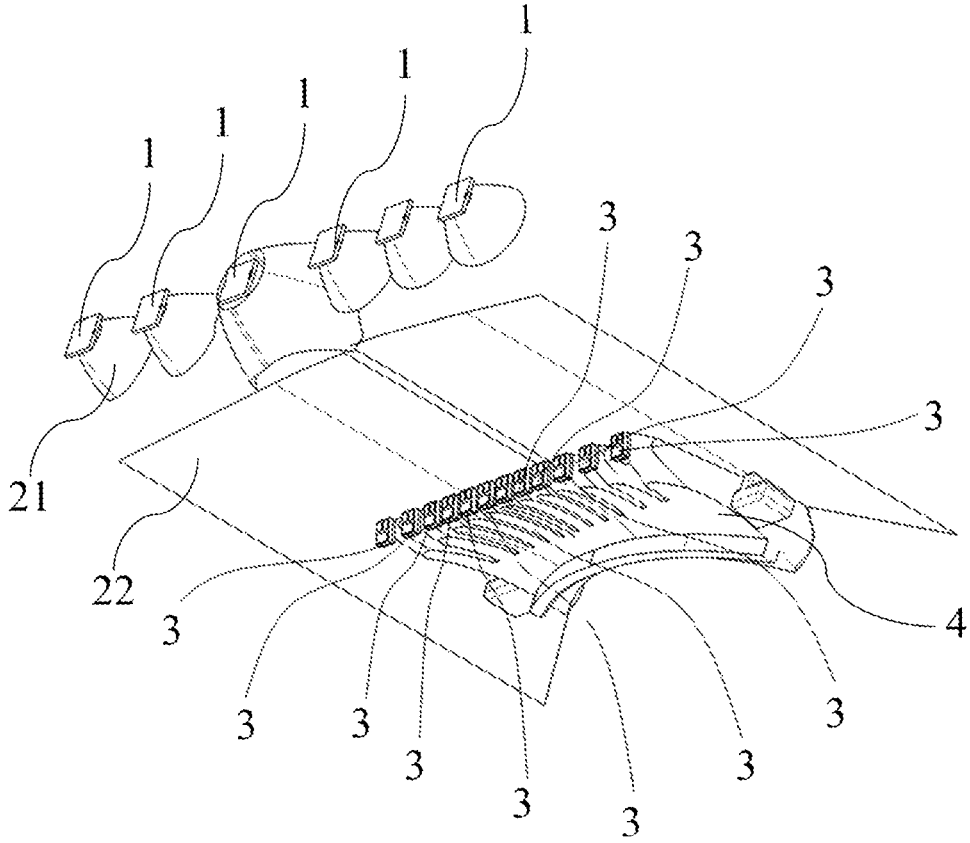
FIG. 2 is another perspective structural diagram of one embodiment of the present disclosure.
Figure 3:
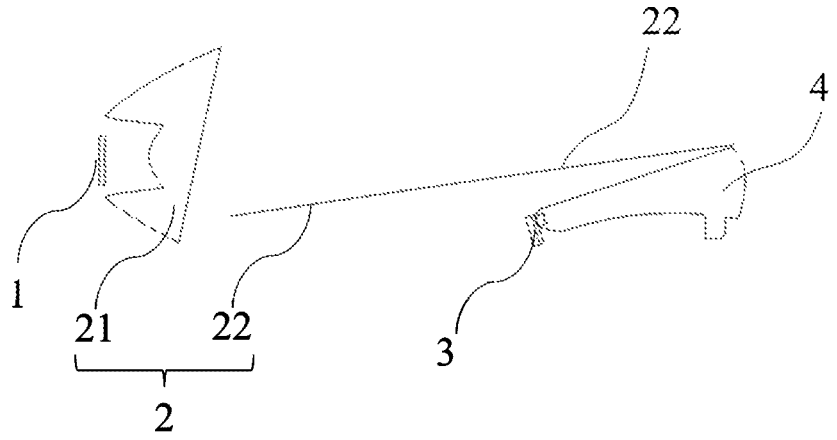
FIG. 3 is a longitudinal sectional view of another embodiment of the present disclosure.

In a basic embodiment of the present disclosure, as shown in FIGS. 1-3, the present disclosure provides a illumination module comprising a low-beam light source 1, a low-beam optical element 2, a high-beam light source 3 and a high-beam optical element 4, wherein the low-beam optical element 2 comprises a light incident portion 21 and a reflection portion 22, the light incident portion 21 is configured as a light gathering structure, and the low-beam light source 1 is arranged at a position where the low-beam beam generated by the low-beam light source 1 can pass through the light incident portion 21; the reflection portion 22 is arranged below a light emission direction of the light incident portion 21 along the light emission direction, and a cut-off line is formed at a front end of the reflection portion 22; and the high-beam light source 3 and the high-beam optical element 4 are arranged below the reflection portion 22.

Specifically, a foremost end of the reflecting part 21 is in the shape of a low-beam cutoff line so that an upper boundary of the light shape of the low beam can form a corresponding cutoff line. The cutoff line is a technical term for a person skilled in the art and belongs to a general structure.

Due to its light gathering structure, the light incident portion 21 in the illumination module provided by the above basic technical solution of the present disclosure can collect and collimate the light beams emitted by the low-beam light source 1, and then emit them; and at this point, part of the low beams are incident on the reflection portion 22, and the reflection part 22 can reflect and reuse the low beams which then propagate forward to form effective light, thus ensuring the utilization efficiency of low-beam light energy. Moreover, the low-beam optical element 2 is formed through combination of the light incident portion 21 of the light gathering structure and the reflection portion 22, thus occupying less space compared to using a reflector separately.

The light incident portion 21 may be of any structure capable of gathering light. In one embodiment of the present disclosure, the light incident portion 21 is of a cup-shaped structure capable of gathering light. The cup-shaped structure capable of gathering the light refers to the formation of a collimator, the middle position of which is a concave cavity with an annular side wall, and the outer wall is a curved surface with a gradually enlarged cross section, as shown in FIGS. 1-3.

In order to ensure sufficient brightness of the low beams, there are the plurality of low-beam light sources 1, and the plurality of low-beam light sources 1 are arranged in a row at intervals. In this way, heat can be dispersed better, heat dissipation between the low-beam light sources 1 is facilitated, the heat dissipation performance of the illumination module is improved, and the service life of the illumination module is prolonged; and meanwhile, low-beam cut-off lines generated by the low-beam light sources 1 can be positioned on the same line. Specifically, the number of the low-beam light sources 1 can be adjusted as needed by those skilled in the art. Generally, the three or more light sources 1 are required as a low beam light sources.

Preferably, there are the plurality of light incident portions 21, and the low-beam light sources 1 and the light incident portion 21 are arranged in a one-to-one correspondence mode. In the present embodiment, the number of the light incident portions 21 is equal to the number of the low-beam light sources 1. It is understood that the number of the light incident portions 21 may also be greater than the number of the low-beam light sources 1, which does not affect its function, because all the light emitted by the low-beam light sources 1 is provided with the light incident portion 21; and the only difference is that, in this case, there are no low-beam light sources 1 arranged at the positions corresponding to some light incident portion 21. This is generally due to standardization, i.e. different numbers of the low-beam light sources 1 are provided according to different optical performance requirements, but only one low-beam optical element 2 is arranged, so as to reduce R&D and manufacturing costs.

In a preferred embodiment of the present disclosure, the reflection portion 22 is a fully reflection portion, which can reflect back all the light beams incident on the reflection portion 22 and make them propagate forward to form effective light, thus increasing the utilization efficiency of light energy.

Figure 5:
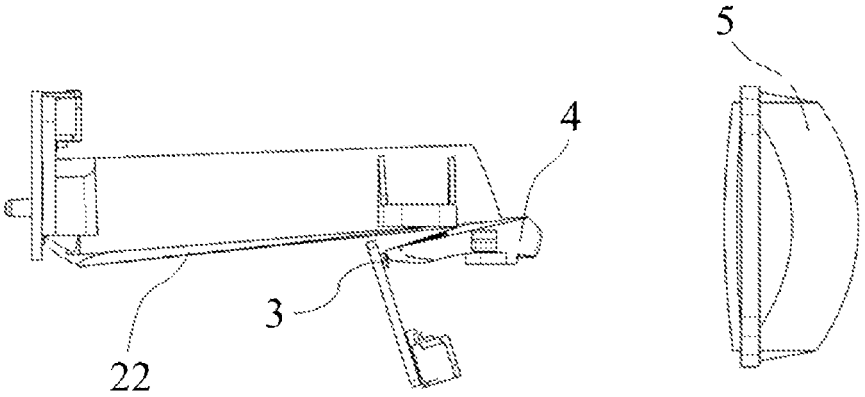
FIG. 5 is a side view of another embodiment of the present disclosure.
Figure 6:
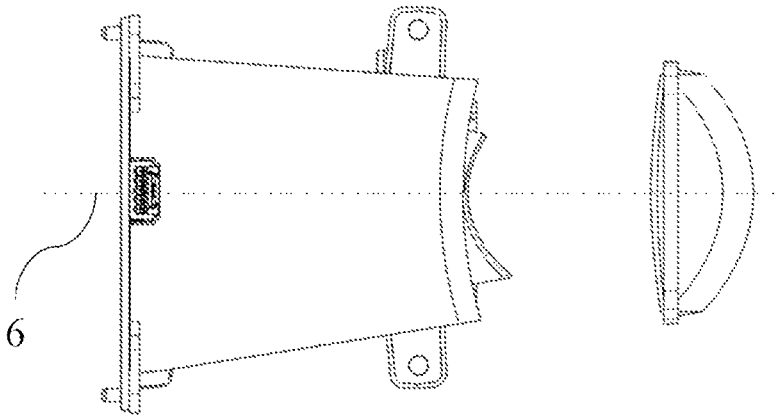
FIG. 6 is a top view of another embodiment of the present disclosure.
Figure 7:
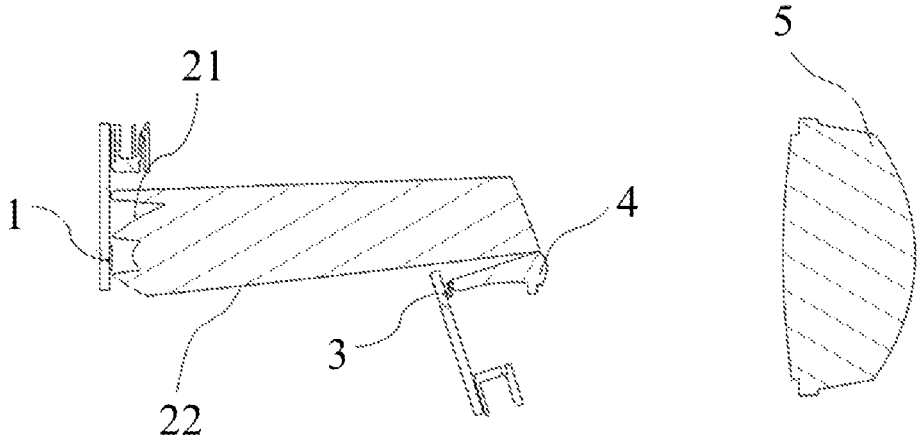
FIG. 7 is a longitudinal sectional view of another embodiment of the present disclosure.

In the present disclosure, as shown in FIGS. 2 and 3, the light incident portions 21 are independently arranged at an end region of the reflection portion 22 and are spaced from the reflection portion 22 at interval, the reflection portion 22 is of a plate-like structure, and the thickness of the front end of the reflection portion 22 is less than or equal to 1 mm; and the reflection portion 22 may be made of plastic or metal, and its surface is aluminized to further improve the reflectivity. Alternatively, as shown in FIG. 4-5 or 7, the light incident portions 21 are arranged at the end of the reflection portion 22 and are integrated with the reflection portion 22, lower surfaces of the light incident portions 21 are provided as the reflection portion 22, and the front end of the reflection portion 22 is connected with an arc-shaped light emission surface; the integral low-beam optical element 2 can reduce the number of parts and manufacturing and installation costs as well to a certain extent; and in addition, the integral low-beam optical element 2 enables light collected and collimated by the light incident portions 21 to better and more propagate inside the low-beam optical element 2, and the arc-shaped light emission surface can further adjust the emission light shape.

In one embodiment of the present disclosure, the high-beam light source 3 is Matrix light sources, and there are the plurality of high-beam light sources 3, the number of the high-beam light sources 3 generally corresponds to the number of pixels of the high-beam light sources 3, that is, the number of the high-beam light sources 3 is equal to the number of subdivided illumination areas of the high-beam light sources 3, and this number can also be adjusted by a person skilled in the art as needed. There may be 12 high-beam light sources 3 herein which are arranged into a row from left to right to realize a single row of high-beam light shapes. Of course, those skilled in the art can also arrange the high-beam light sources into multiple rows as required to realize multiple rows of high-beam light shapes. Preferably, the high-beam light sources 3 are single-chip LED light sources, and the chip light sources are sufficient to meet the design requirements of the Matrix light shape.

In the present disclosure, an upper boundary of a front end of the high-beam optical element 4 is in contact with the front end of the reflection portion 22 so that solid connection and smooth transition of low-beam and high-beam shapes can be realized; or a certain gap may be provided between the two, however, the distance between the upper boundary of the front end of the high-beam optical element 4 and the front end of the reflection portion 22 is less than or equal to 2 mm, so as to avoid nonuniform transition of the low-beam shapes and the high-beam shapes.

The middle position of the low-beam shape generally requires higher illumination intensity than the side positions, and multi-chip in the middle can make the low-beam shape meet this requirement better. In one embodiment of the present disclosure, the number of light emitting chips of the low-beam light sources 1 close to the optical axis 6 is greater than or equal to 2. Specifically, the number of the light emitting chips of the low-beam light source 1 closest to the optical axis is two, and a single chip is provided on each side. The optical axis 6 refers to an axis passing through a focal point of a lens 5 and pointing in the front-rear direction.

In a preferred embodiment of the present disclosure, as shown in FIGS. 3-5, the high-beam optical element 4 comprises light inlet portions 41 and light guide channels 42, wherein each light inlet portion 41 is configured as a light gathering structure, the light inlet portions 41 and the light guide channels 42 are arranged in a one-to-one correspondence mode, the light guide channel of each high-beam light source 3 is an independent light guide channel with gaps, and front ends of the light guide channels 42 converge to form a curved light outlet portion 43. Specifically, light inlet portion 41 is also of a cup-shaped structure capable of gathering light.

It can be understood that this embodiment can also be used in conjunction with the lens 5 for illumination of a motor vehicle, forming a motor vehicle illumination module with the lens 5, and at this point, the optical axis refers to the axis passing through the focal point of the lens 5 and pointing in the front-rear direction. A forwardmost end of the reflection portion 22 and a forwardmost end of the high-beam optical element 4 are jointly provided at the focal point of the lens 5. The lens 5 shown in FIGS. 4-7 is a biconvex lens, and those skilled in the art can also change it to a plano-convex lens as needed. Such simple equivalent replacement falls within the scope of protection of the present disclosure.

In a relatively preferred embodiment of the present disclosure, as shown in FIGS. 1-3, the illumination module comprises six low-beam light sources 1, a low-beam optical element 2, 12 Matrix light sources and a Matrix optical element, wherein the low-beam light sources 1 are arranged in a single row at intervals from left to right, and the low-beam optical element 2 comprises six light incident portions 21 and a reflection portion 22 arranged in sequence along a light emission direction; the light incident portions 21 are of a cup-shaped structure capable of gathering light, the middle position of which is a concave cavity with an annular side wall, and the outer wall is a curved surface with a gradually enlarged cross section; the reflection portion 22 is arranged at the ends, in the light emission direction, of the light incident portions 22 and is configured as a plate-like structure, the reflection portion 22 is made of a metal material and plated with an aluminum film on the surface, and a front end of the reflection portion 22 is formed as a low-beam cut-off line; the Matrix light sources and the Matrix optical element are arranged below the reflection portion 22, and the 12 Matrix light sources are arranged in a row at intervals; the Matrix optical element comprises light inlet portions 41 and light guide channels 42 which are sequentially connected, the light inlet portions 41 are configured as a cup-shaped structure capable of gathering light and are arranged in one-to-one correspondence to the Matrix light sources, a tail end of each light inlet portion 41 is connected with the corresponding light guide channel 42, and tail ends of all the light guide channels 42 are converged into one curved light outlet surface; and the number of light emitting chips of the low-beam light source 1 closest to an optical axis 6 is two, a single chip is provided on each side, the Matrix light sources are all single-chip light sources, and an upper boundary of a foremost end of the Matrix optical element is connected with a foremost end of the reflection portion 22.

In another relatively preferred embodiment of the present disclosure, as shown in FIGS. 4-7, the illumination module comprises six low-beam light sources 1, a low-beam optical element 2, 12 Matrix light sources and a Matrix optical element, wherein the low-beam light sources 1 are arranged in a single row at intervals from left to right, and the low-beam optical element 2 comprises six light incident portions 21 and a reflection portion 22 arranged in sequence along a light emission direction; the light incident portions 21 are of a cup-shaped structure capable of gathering light, the middle position of which is a concave cavity with an annular side wall, and the outer wall is a curved surface with a gradually enlarged cross section; the reflection portion 22 is integrated with the light incident portions 22, a lower surface of an inner side of each light incident portion 21 serves as the reflection part 22, and a front end of the reflection portion 22 is formed as a low-beam cut-off line; the Matrix light sources and the Matrix optical element are arranged below the reflection portion 22, and the 12 Matrix light sources are arranged in a row at intervals; the Matrix optical element comprises light inlet portions 41 and light guide channels 42 which are sequentially connected, the light inlet portions 41 are configured as a cup-shaped structure capable of gathering light and are arranged in one-to-one correspondence to the Matrix light sources, a tail end of each light inlet portion 41 is connected with the corresponding light guide channel 42, and tail ends of all the light guide channels 42 are converged into one curved light outlet surface; and the number of light emitting chips of the low-beam light source 1 closest to an optical axis 6 is two, a single chip is provided on each side, the Matrix light sources are all single-chip light sources, and an upper boundary of a foremost end of the Matrix optical element is spaced from a foremost end of the reflection portion 22 by 2 mm.

According to the illumination module provided by some embodiments of the present disclosure, the light incident portions 21 and the reflection portion 22 are arranged on the low-beam optical element 2, and each light incident portion 21 is designed into the light gathering structure, so that the light emitted by the low-beam light sources 1 is collected and collimated through the light incident portions 21 of the light gathering structure, and the utilization efficiency of light energy is improved. The reflection portion 22 is arranged below the light emission direction of the light incident portions 21 along the light emission direction, so that a light beam incident on the reflection portion 22 is reused through the reflection portion 22, in this way, the light beam propagates forward to form effective light, and the utilization efficiency of low-beam light energy is improved. Besides, by arranging the light incident portions 21 of the light gathering structure and the reflection portion 22, the separate arrangement of a large reflector is not needed so that the space occupied by the illumination module can be reduced and the miniaturization of the whole illumination module can be realized. Moreover, the front end of the reflection portion 22 is provided with the cut-off line, so that there is no need to separately set up a cut-off line, and the structure of the illumination module is simplified. Meanwhile, the plurality of low-beam light sources 1 and high-beam light sources 3 are provided and are arranged at intervals, so that heat at the light sources is dispersed, heat dissipation of the whole illumination module is facilitated, and the service life of the module is prolonged.

In addition, the embodiments of the present disclosure also provide a vehicle lamp, which comprises the illumination module provided by the above embodiments.

Meanwhile, the embodiments of the present disclosure also provide a vehicle, which comprises the illumination module or vehicle lamp provided by the above embodiments.

The preferred embodiments of the present disclosure have been described in detail above with reference to the accompanying drawings, but the present disclosure is not limited thereto. Within the scope of the technical concept of the present disclosure, various simple modifications can be made to the technical solution of the present disclosure, including the combination of various specific technical features in any suitable way. In order to avoid unnecessary repetition, various possible combinations will not be described separately in the present disclosure. However, these simple modifications and combinations should also be regarded as the content of the present disclosure and all fall within the scope of protection of the present disclosure.

What is claimed is:

1. An illumination module, comprising a low-beam light source, a low-beam optical element, a high-beam light source and a high-beam optical element, wherein the low-beam optical element comprises a light incident portion and a reflection portion, the light incident portion is configured as a light gathering structure, and the low-beam light source is arranged at a position where the low-beam beam generated by the low-beam light source can pass through the light incident portion; the reflection portion is arranged below a light emission direction of the light incident portion along the light emission direction, and a cut-off line is formed at a front end of the reflection portion; the high-beam light source and the high-beam optical element are arranged below the reflection portion.

2. The illumination module according to claim 1, wherein the light incident portion is of a cup-shaped structure capable of gathering light.

3. The illumination module according to claim 1, wherein there are a plurality of the low-beam light sources, and the low-beam light sources are arranged in a row at intervals.

4. The illumination module according to claim 3, wherein there are a plurality of the light incident portions, and the low-beam light sources and the corresponding light incident portions are arranged in a one-to-one correspondence mode.

5. The illumination module according to claim 1, wherein the reflection portion is a fully reflection portion.

6. The illumination module according to claim 1, wherein the light incident portion is independently arranged at an end region of the reflection portion and is spaced from the reflection portion at intervals, the reflection portion is of a plate-like structure, and a thickness of the front end of the reflection portion is less than or equal to 1 mm; or the light incident portion is arranged at the end of the reflection portion and is integrated with the reflection portion, a lower surface of the light incident portion is provided as the reflection portion, and the front end of the reflection portion is connected with an arc-shaped light emission surface.

7. The illumination module according to claim 1, wherein the high-beam light source is a Matrix light source, and there are a plurality of the high-beam light sources.

8. The illumination module according to claim 7, wherein the high-beam light sources are single-chip LED light sources.

9. The illumination module according to claim 7, wherein the high-beam light sources are arranged at intervals into one row, or the high beam light sources are arranged at intervals into multiple rows in a vertical direction.

10. The illumination module according to claim 7, wherein an upper boundary of a front end of the high-beam optical element is in contact with the front end of the reflection portion; or a distance between the upper boundary of the front end of the high-beam optical element and the front end of the reflection portion is less than or equal to 2 mm.

11. The illumination module according to claim 1, wherein the number of light emitting chips of the low-beam light sources close to the optical axis is greater than or equal to 2.

12. The illumination module according to claim 1, wherein the high-beam optical element comprises light inlet portions and light guide channels, each light inlet portion is configured as a light gathering structure, the light inlet portions and the light guide channels are arranged in a one-to-one correspondence mode, and front ends of the light guide channels form a curved light outlet portion.

13. A vehicle lamp, comprising the illumination module according to claim 1.

14. A vehicle, comprising the vehicle lamp according to claim 13.

15. The vehicle lamp according to claim 13, wherein the light incident portion is independently arranged at an end region of the reflection portion and is spaced from the reflection portion at intervals, the reflection portion is of a plate-like structure, and a thickness of the front end of the reflection portion is less than or equal to 1 mm; or the light incident portion is arranged at the end of the reflection portion and is integrated with the reflection portion, a lower surface of the light incident portion is provided as the reflection portion, and the front end of the reflection portion is connected with an arc-shaped light emission surface.

16. The vehicle lamp according to claim 13, wherein the high-beam light source is a Matrix light source, and there are a plurality of the high-beam light sources;

an upper boundary of a front end of the high-beam optical element is in contact with the front end of the reflection portion; or a distance between the upper boundary of the front end of the high-beam optical element and the front end of the reflection portion is less than or equal to 2 mm.

17. The vehicle lamp according to claim 13, wherein the high-beam optical element comprises light inlet portions and light guide channels, each light inlet portion is configured as a light gathering structure, the light inlet portions and the light guide channels are arranged in a one-to-one correspondence mode, and front ends of the light guide channels form a curved light outlet portion.

18. The vehicle according to claim 14, wherein the light incident portion is independently arranged at an end region of the reflection portion and is spaced from the reflection portion at intervals, the reflection portion is of a plate-like structure, and a thickness of the front end of the reflection portion is less than or equal to 1 mm; or the light incident portion is arranged at the end of the reflection portion and is integrated with the reflection portion, a lower surface of the light incident portion is provided as the reflection portion, and the front end of the reflection portion is connected with an arc-shaped light emission surface.

19. The vehicle according to claim 14, wherein the high-beam light source is a Matrix light source, and there are a plurality of the high-beam light sources;

an upper boundary of a front end of the high-beam optical element is in contact with the front end of the reflection portion; or a distance between the upper boundary of the front end of the high-beam optical element and the front end of the reflection portion is less than or equal to 2 mm.

20. The vehicle according to claim 14, wherein the high-beam optical element comprises light inlet portions and light guide channels, each light inlet portion is configured as a light gathering structure, the light inlet portions and the light guide channels are arranged in a one-to-one correspondence mode, and front ends of the light guide channels form a curved light outlet portion.

* * * * *